US008549805B2

(12) United States Patent
Kim et al.

(10) Patent No.: US 8,549,805 B2
(45) Date of Patent: Oct. 8, 2013

(54) GRID-TYPE DROP-PANEL STRUCTURE, AND A CONSTRUCTION METHOD THEREFOR

(75) Inventors: Kwang Man Kim, Seoul (KR); Sang Mun Yun, Seoul (KR)

(73) Assignee: Baro Construction Key-Technologies Co., Ltd. (KR)

( * ) Notice: Subject to any disclaimer, the term of this patent is extended or adjusted under 35 U.S.C. 154(b) by 191 days.

(21) Appl. No.: 12/918,184

(22) PCT Filed: Feb. 18, 2009

(86) PCT No.: PCT/KR2009/000765

§ 371 (c)(1),
(2), (4) Date: Nov. 16, 2010

(87) PCT Pub. No.: WO2009/104897

PCT Pub. Date: Aug. 27, 2009

(65) Prior Publication Data

US 2011/0192108 A1 Aug. 11, 2011

(30) Foreign Application Priority Data

Feb. 18, 2008 (KR) ..... 10-2008-0014548
Feb. 18, 2009 (KR) ..... 10-2009-0013414

(51) Int. Cl.
*E04B 1/00* (2006.01)

(52) U.S. Cl.
USPC ..... 52/260; 52/253; 52/283; 52/745.18

(58) Field of Classification Search
USPC ..... 52/252, 253, 260, 262, 283, 236.3, 52/745.17, 745.18
See application file for complete search history.

(56) References Cited

U.S. PATENT DOCUMENTS

| | | | | | |
|---|---|---|---|---|---|
| 692,309 | A | * | 2/1902 | Knoche | 52/261 |
| 926,497 | A | * | 6/1909 | Kahn | 52/253 |
| 947,769 | A | * | 1/1910 | Conzelman | 52/260 |
| 998,479 | A | * | 7/1911 | Eisen | 52/236.3 |
| 1,003,384 | A | * | 9/1911 | Turner | 52/253 |
| 1,009,712 | A | * | 11/1911 | Anderson | 52/253 |

(Continued)

FOREIGN PATENT DOCUMENTS

| | | |
|---|---|---|
| JP | 09-291545 | 11/1997 |
| JP | 11-159000 | 6/1999 |

(Continued)

OTHER PUBLICATIONS

International Search Report prepared by the Korean Intellectual Property Office issued on Sep. 16, 2009, for International Application No. PCT/KR2009/000765.

*Primary Examiner* — Brian Glessner
*Assistant Examiner* — Adriana Figueroa
(74) *Attorney, Agent, or Firm* — Sheridan Ross P.C.

(57) ABSTRACT

A latticing drop panel structure includes a plurality of columns (100 or 101) or walls, and a connecting member (210) including a concrete drop panel (219) having a cross-section area larger than that of the column (100 or 101) or the wall, wherein the connecting member (210) having four unit rods 212, surrounded around the drop panel (219) in a latticing form, wherein the unit rods (212) are parallel with the respective sides of the column and cross at the same level, whereby sagging displacement of the slab is reduced due to the existence of the drop panel.

15 Claims, 29 Drawing Sheets

(56) References Cited

U.S. PATENT DOCUMENTS

| | | | | | |
|---|---|---|---|---|---|
| 1,036,050 | A | * | 8/1912 | Wunder | 52/260 |
| 1,052,918 | A | * | 2/1913 | Higgins | 52/283 |
| 1,115,387 | A | * | 10/1914 | Brown | 52/260 |
| 1,119,406 | A | * | 12/1914 | Danielson | 52/260 |
| 1,128,912 | A | * | 2/1915 | Snyder | 52/260 |
| 1,248,049 | A | * | 11/1917 | Wunder | 52/220.3 |
| 1,258,917 | A | * | 3/1918 | Lally | 52/260 |
| 1,335,780 | A | * | 4/1920 | Barton | 52/253 |
| 1,452,677 | A | * | 4/1923 | Davidson | 52/251 |
| 1,461,891 | A | * | 7/1923 | Coney | 52/253 |
| 1,476,572 | A | * | 12/1923 | Allbright | 52/260 |
| 1,516,074 | A | * | 11/1924 | Borg | 52/236.9 |
| 1,536,942 | A | * | 5/1925 | Skaer | 52/260 |
| 1,550,317 | A | * | 8/1925 | Hardison | 52/260 |
| 1,804,342 | A | * | 5/1931 | Hyde | 52/253 |
| 1,950,422 | A | * | 3/1934 | Wheeler | 52/260 |
| 2,033,595 | A | * | 3/1936 | Strehan | 52/260 |
| 2,697,930 | A | * | 12/1954 | Cheskin | 52/260 |
| 2,768,520 | A | * | 10/1956 | Strehan | 52/260 |
| 2,816,435 | A | * | 12/1957 | Donahue et al. | 52/260 |
| 2,930,221 | A | * | 3/1960 | Strehan | 52/283 |
| 3,435,572 | A | * | 4/1969 | Fuchs | 52/251 |
| 3,903,667 | A | * | 9/1975 | Zetlin | 52/223.7 |
| 4,443,985 | A | * | 4/1984 | Moreno | 52/236.8 |
| 5,181,359 | A | * | 1/1993 | Chana et al. | 52/253 |
| 6,061,992 | A | * | 5/2000 | Vincent | 52/841 |
| 8,011,147 | B2 | * | 9/2011 | Hanlan | 52/252 |
| 2010/0024332 | A1 | * | 2/2010 | Valaire | 52/252 |

FOREIGN PATENT DOCUMENTS

| | | |
|---|---|---|
| JP | 2004-308316 | 11/2004 |
| JP | 2006-299693 | 11/2006 |
| KR | 1020060019006 | 3/2006 |
| KR | 1020060075229 | 4/2006 |

* cited by examiner

PRIOR ART (a)

GRID-TYPE DROP-PANEL STRUCTURE, AND A CONSTRUCTION METHOD THEREFOR

CROSS REFERENCE TO RELATED APPLICATIONS

This application is a national stage application under 35 U.S.C. 371 of PCT Application No. PCT/KR2009/000765 having an international filing date of 18 Feb. 2009, which designated the United States, which PCT application claimed the benefit of Korean Patent Application Nos. 10-2008-0014548 filed Feb. 18, 2008, and 10-2009-0013414 filed on Feb. 18, 2009, the entire disclosure of each of which are hereby incorporated herein by reference.

TECHNICAL FIELD

The present invention relates to a latticing drop panel structure and a constructing method thereof.

BACKGROUND ART

FIG. 1 is a front view illustrating the installation structure of a column and a girder or a slab according to the related art.

The installation structure of FIG. 1 includes columns 10 set up at regular intervals, girders or slabs 20 connected between the adjacent columns 10.

The girder or slab 20 is directly connected to the center or side of the column 10, and the connected girder or slab sags under the weight or load of an installation (not shown) placed thereon.

According to a standard diagram handbook of machine design, uniformly distributed load can be calculated by the following formula.

$$\delta max=5wL^4/384EI$$

where δmax: a quantity of maximum sagging w: load

L: length

E: Young's Modulus

I: secondary moment of area

The quantity of maximum sag (δmax) is proportional to the fourth square of the whole length L of the girder or slab.

In FIG. 1, the whole length L corresponds to an effective length l of the girder or slab 20 between the columns 10 where sagging occurs, and the maximum sagging (δmax) corresponds to bent displacement e that is the length of sagging at the center of the girder or slab 20.

However, in such installation structures, the effective length l of the girder or slab 20 is too long, so that the sag occurring on the girder or slab 20. To avoid this problem, a girder or slab 20, the secondary moment I of area of which is high, should be used Thus, a girder or slab 20 with larger thickness and size is required, which problematically increases the cost of the girder or slab greatly.

DISCLOSURE

Technical Problem

The present invention is directed to drop panel structures in which the thickness or size of a girder or slab is not large, while bending displacement of the girder or slab is small, and a constructing method thereof.

Technical Solution

In order to accomplish the above object of the present invention, according to an aspect of the present invention, the latticing drop panel structure includes a plurality of columns (100 or 101) or walls; and a connecting member (210) including a concrete drop panel (219) having a cross-section area larger than that of the column (100 or 101) or the wall, in which the connecting member (210) have four unit rods 212, surrounded around the drop panel (219) in a latticing form, in which the unit rods (212) are parallel with the respective sides of the column and cross at the same level.

In an exemplary embodiment, the column (100 or 101) may include reinforced concrete or steel-framed reinforced concrete, the connecting member (210) may be composed of H-section steel, and the unit rod (212) may have a connecting end (600 or 680), a cross-section area of which is larger at an upper side than at a lower side.

In an exemplary embodiment, a slant tension member (410 OR 412) may be coupled to the connecting member (210) in the same or slant direction as or from the connecting member (210), the unit rod (212) may be a reinforced concrete beam (700) or a steel beam (800) in which a plurality of main reinforcement steel (710) is coiled with stirrups (712).

According to another aspect of the present invention, the method of constructing latticing drop panel structures includes the steps of: installing a connecting member (210) in places on the respective floors of a plurality of reinforced concrete columns (100) or walls, the connecting member having an internal space (214), the cross-section area of which is larger than that of the column (100) or wall; connecting a linear member (220) to the plurality of connecting members (210); installing an upper horizontal mold (320) between the linear members (220); and pouring concrete into the internal space (214) and onto the upper horizontal mold (320) to form a drop panel (219) and a slab structure.

According to a further aspect of the present invention, the method of constructing latticing drop panel structures includes the steps of: installing a plurality of vertical molds (102) shaped like a reinforced concrete column (100) or wall; installing a connecting member (210) in places on the respective floors of the vertical mold (102), the connecting member having an internal space (214), the cross-section area of which is larger than that of the column (100) or wall; pouring concrete into the vertical mold (102); connecting a linear member (220) to the plurality of connecting members (210); installing an upper horizontal mold (320) between the linear members (220); and pouring concrete into the internal space (214) and onto the upper horizontal mold (320) to form a drop panel (219) and a slab structure.

According to still another aspect of the present invention, the method of constructing latticing drop panel structures includes the steps of: installing a plurality of vertical molds (102), shaped like a reinforced concrete column (100) or wall; installing a connecting member (210) in places on the respective floors of the vertical mold (102), the connecting member having an internal space (214), the cross-section area of which is larger than that of the column (100) or wall; connecting a linear member (220) to the plurality of connecting members (210); installing an upper horizontal mold (320) between the linear members (220); and pouring concrete into the internal space (214) and onto the upper horizontal mold (320) to form a drop panel (219) and a slab structure in connection with the column (100) or wall.

According to yet another aspect of the present invention, the method of constructing latticing drop panel structures includes the steps of: installing a plurality of section steel (400), used in a steel-framed reinforced concrete column (101), in a vertical manner; installing a connecting member (210) in places on the respective floors of the section steel (400), the connecting member having an internal space (214), the cross-section area of which is larger than that of the column (101); connecting a linear member (220) to the plurality of connecting members (210); installing a vertical mold (102) shaped like the column (101); installing an upper horizontal mold (320) between the linear members (220); pouring concrete into the vertical mold (102) to form the column (101); and pouring concrete into the internal space (214) and onto the upper horizontal mold (320) to form a drop panel (219) and a slab structure.

In an exemplary embodiment, a coupling section (218) may be embedded in the reinforced concrete column (100) to connect the connecting member (210) and the column (100) to each other; the connecting member (210) may be composed of four unit rods (212) crossed into a latticing form with the internal space (214) formed at the center of the latticing form.

In an exemplary embodiment, a lower horizontal mold (330) may be installed on a lower side of the internal space (214), and the connecting member (210) and the vertical mold (102) may be fastened by a bolt.

Advantageous Effects

As set forth above, according to exemplary embodiments of the invention, bending displacement occurring due to sagging of the linear member or the slab can be reduced by the structure of connecting member including the drop panel.

Further, installation of the horizontal mold on the lower side of the internal space enables the pouring of concrete into the internal space, and the internal space may be defined by four unit rods.

Furthermore, by the structure of latticed connecting member, sagging of the slab can be maximally restricted, while the drop panel (219) does not have to be made greater, thereby saving the constructing cost and making the best use of the technical benefits.

MODE FOR INVENTION

Figure 1:
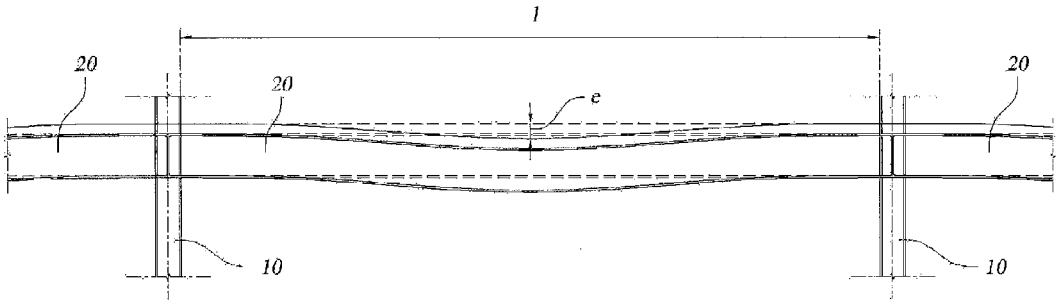
FIG. 1 is a front view illustrating installation structures of columns and girders or slabs according to the related art.

Description will now be made of exemplary embodiments of the present invention with reference to the accompanying drawings. Throughout this document, reference should be made to the drawings, in which the same reference numerals and signs are used throughout the different drawings to designate the same or similar components. In the following description of the present invention, detailed descriptions of known functions and components incorporated herein will be omitted when they may make the subject matter of the present invention unclear.

Figure 2:
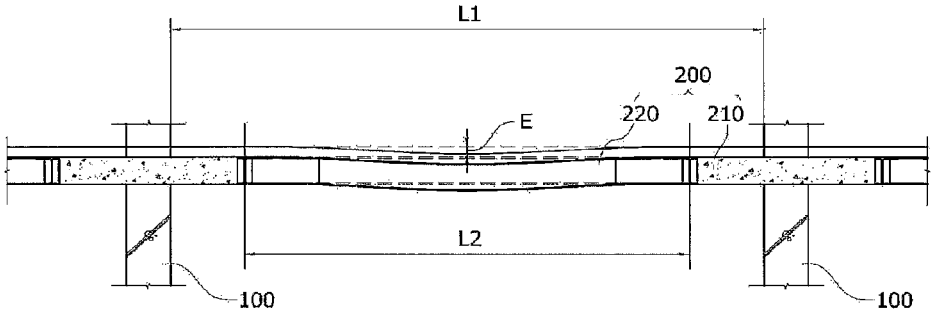
FIG. 2 is a front view illustrating the installation structures of columns and girders according to an embodiment.
Figure 2:
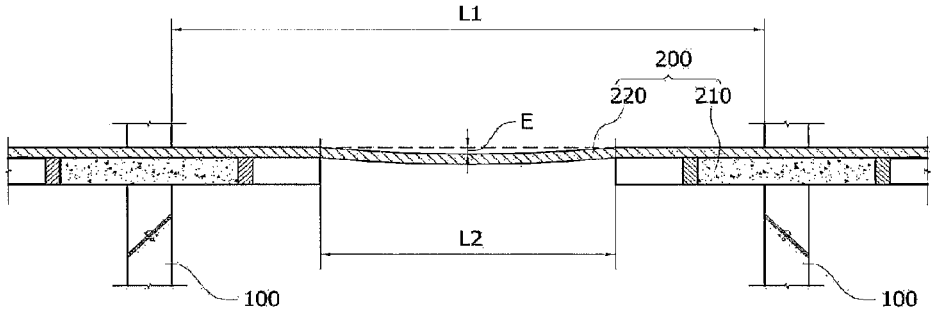

FIGS. 2(*a*) and 2(*b*) are front views illustrating the installation structures of columns and girders according to an embodiment, in which FIG. 2(*a*) shows the case that a girder and a slab all are provided by a linear member, and FIG. 2(*b*) shows the case that only a slab is provided by a linear member.

In the constructing method of drop panel structures as shown in FIG. 2, the installation structures include a plurality of columns 100 set up at regular intervals, and coupling girders or slabs 200 connected between the columns 100.

The coupling girder or slab 200 includes a connecting member 210 and a linear member 220 as a girder or slab, provided between the connecting members 210.

The connecting member 210 includes a drop panel, which is formed by pouring concrete into the connection members as described below, and the drop panel is integrally formed with the column 100 and serves to enlarge the area of the column 100, so that the amount of sagging of the connecting member becomes smaller than that of the linear member 220 on the coupling girder or slab 200.

Thus, the whole length L1 of the coupling girder or slab 200 becomes different from the effective length L2 along which sagging occurs, such that the effective length L2 is smaller than the whole length L1, thereby reducing the sagging displacement E.

Accordingly, unlike the conventional technology, there is no need to enlarge the thickness or size of the linear member 220 in order to increase the secondary moment of area of the linear member 220.

A method of constructing the drop panel structures including the coupling girder or slab 200 will now be described.

First, a first embodiment method of constructing the drop panel structures is as follows.

Figure 3:
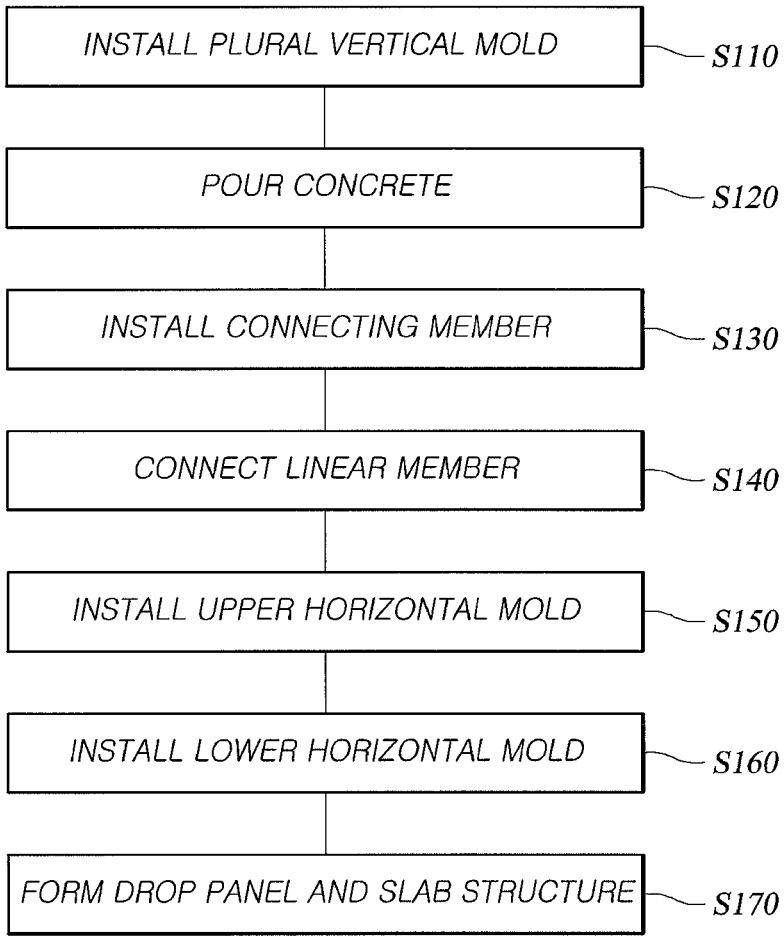
FIG. 3 is a flow chart illustrating a procedure of a first embodiment method of constructing a drop panel structure.
Figure 4:
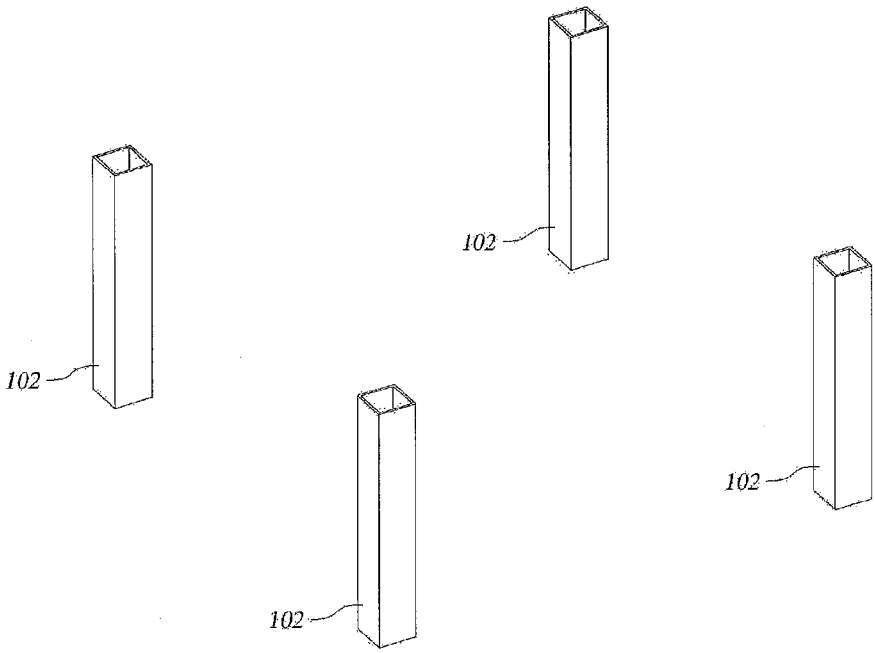
FIG. 4 is a perspective view illustrating a mold for a column.
Figure 5:
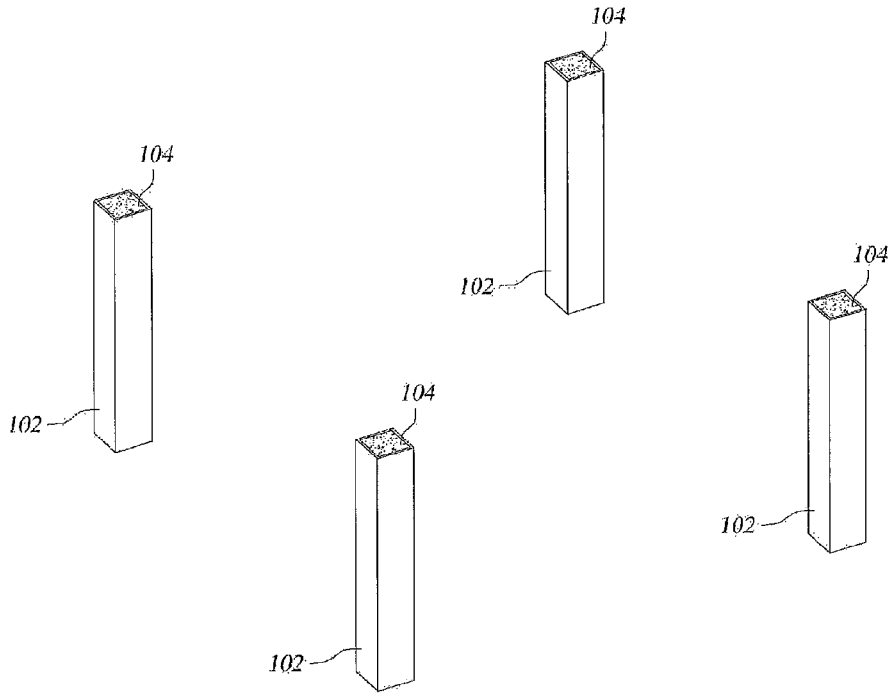
FIG. 5 is a perspective view illustrating the mold of FIG. 4 into which concrete is poured.
Figure 6:
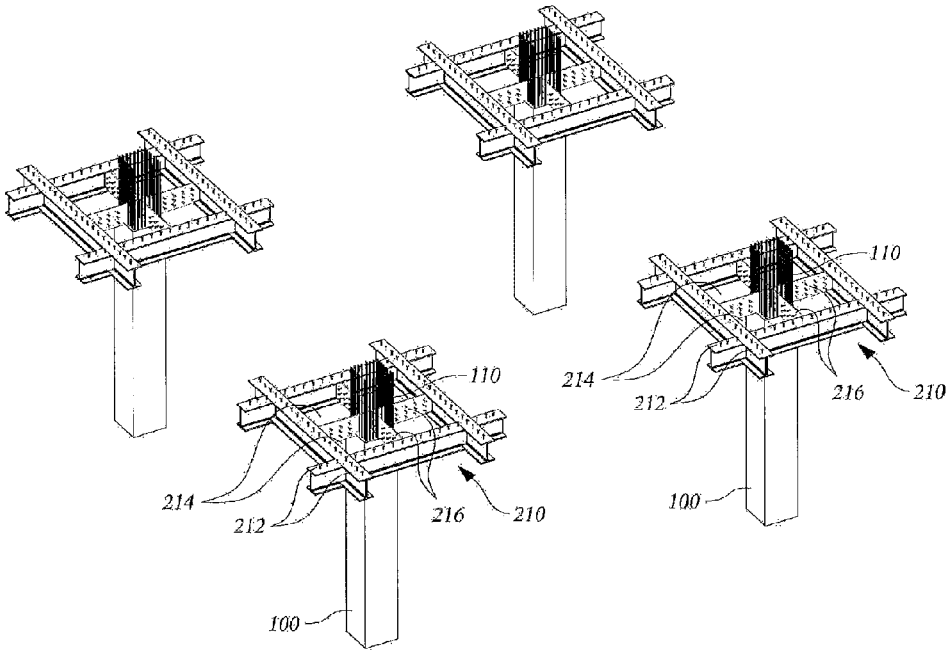
FIG. 6 is a perspective view illustrating the state in which a connecting member is fastened to the column in the course of constructing steps of the drop panel structure.

FIG. 3 is a flow chart illustrating a procedure of the first embodiment method of constructing the drop panel structures, FIG. 4 is a perspective view illustrating a mold for a column, FIG. 5 is a perspective view illustrating the mold of FIG. 4 into which concrete is poured, and FIG. 6 is a perspective view illustrating the state in which a connecting member is fastened to the column in the course of constructing steps of the drop panel structures.

In the first step S110, the plurality of vertical molds 102 is installed as shown in FIG. 4.

In the second step S120, concrete 104 is poured into the vertical mold 102 as shown in FIG. 5.

Through the pouring of the concrete 104 into the vertical mold 102, the reinforced concrete column 100 is formed.

In the third step S130, the connecting member 210 is installed in places of the respective floors of the plurality of reinforced concrete columns 100, in which the connecting member has an internal space 214, the cross-section area of which is larger than that of the column 100.

Here, the column 100 is provided with a plurality of reinforcing rods 110, which protrude upwards from the column.

Further, the column 100 may be replaced with a wall body, and in this case, the cross-section area of the column corresponds to that of the wall body.

Meanwhile, while the embodiment illustrated that the unit rod 212 of the connecting member 210 is H-section steel, a variety of section steels, including I-section steel, T-section steel, and the like, can be used as needed. However, since the H-section steel has the largest secondary moment of area per section area among the diverse kinds of section steels, the H-section steel is most preferably used to maintain high rigidity.

Figure 7:
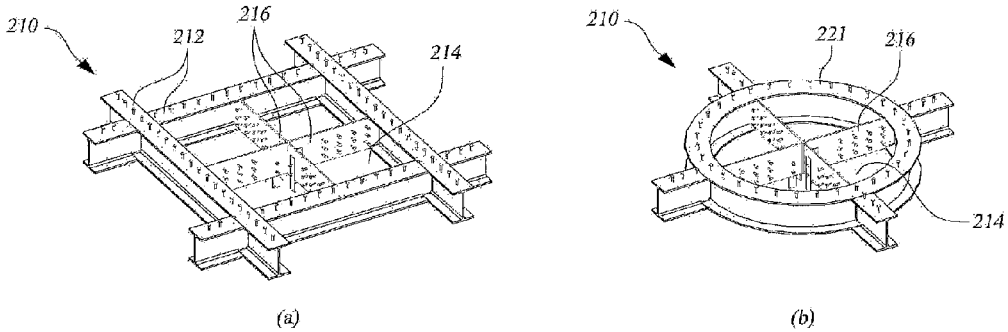
FIG. 7 is a perspective view illustrating the connecting member of FIG. 6.

FIG. 7 is a perspective view illustrating the connecting member of FIG. 6.

As shown in FIG. 7, the connecting member 210 may have two or more kinds of shapes. First, as shown in FIG. 7(*a*), the connecting member 210 is formed into a latticing form, in which the four unit rods 212 cross each other so that the internal space 214 is formed in the center of the latticing form with a "+" type coupling rod 216 provided therein. The coupling rod 216 is installed only if needed, if it is not installed, a mold is installed on the lower side of the connecting member 210 and thus is placed on the upper end of the column 100.

If needed, all of the coupling rods 216 may also be replaced with the mold.

Second, as shown in FIG. 7(*b*), the connecting member 210 is formed into a circular form using a circular rod 221 so that the internal space 214 is formed in the center with a "+" type coupling rod 216 provided therein.

It should be noted that since the cross-section area of the internal space 214 is larger than that of the column 100, if the coupling rod 216 is placed on the upper end of the column 100, the unit rod 212 or the circular rod 221 is separated from the column 100.

If needed, the connecting member 210 may be of a shape such as a lozenge or a polygon, the coupling rod 216 may also be of other shape than the "+" shape.

Figure 8:
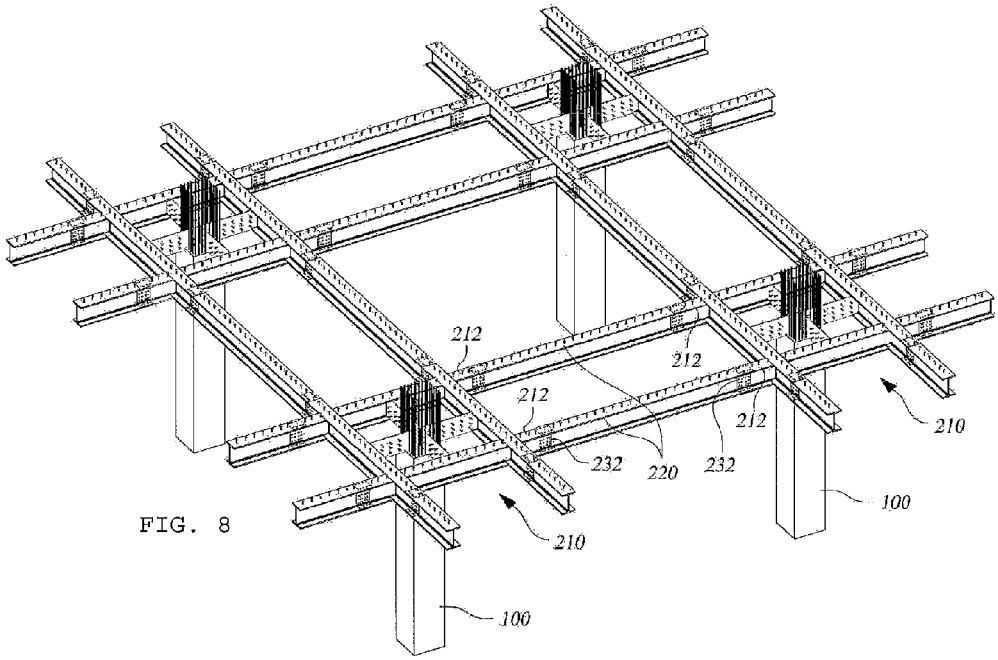
FIG. 8 is a perspective view illustrating the state in which a linear member is connected between the connecting members of FIG. 6.
Figure 9:
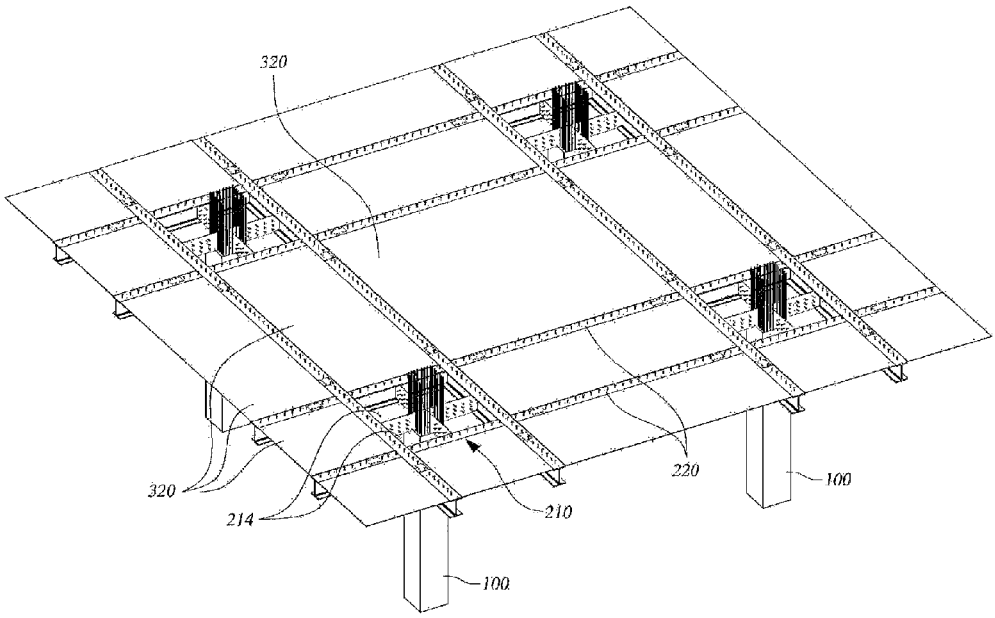
FIG. 9 is a perspective view illustrating the state in which a horizontal mold is installed in the construction of FIG. 8.
Figure 10:
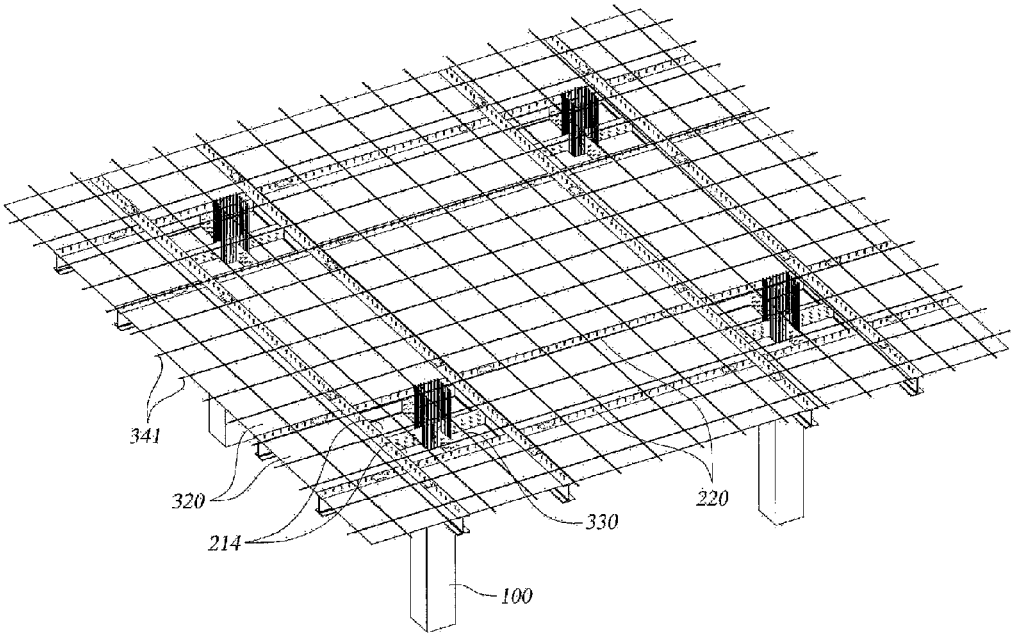
FIG. 10 is a perspective view illustrating the state in which reinforcing rods are additionally placed in the construction of FIG. 9.

FIG. 8 is a perspective view illustrating the state in which a linear member is connected between the connecting members of FIG. 6, FIG. 9 is a perspective view illustrating the state in which a horizontal mold is installed in the construction of FIG. 8, and FIG. 10 is a perspective view illustrating the state in which reinforcing rods are additionally placed in the construction of FIG. 9.

In the fourth step S140, the linear member 220 is connected to the plurality of connecting members 210 as shown in FIG. 8.

Specifically, the linear member 220 is connected between adjacent unit rods 212 of the connecting member 210.

If needed, only the upper horizontal mold 320 is installed between the connecting members 210 without providing the linear member 220.

The connection between the unit rod 212 of the connecting member 210 and the linear member 220 is performed by means of a connecting plate 232 and a plurality of bolts and nuts using a conventional manner, so a detailed description thereof will be omitted.

In the fifth step S150, the upper horizontal mold 320 is installed between the linear members 220 as shown in FIG. 9.

In the sixth step S160, a lower horizontal mold 330 is installed on the lower side of the internal space 214, and reinforcing rods 341 are placed on the upper horizontal mold 320 and the lower horizontal mold 330.

If needed, the fifth step S150 and the sixth step S160 may implemented concurrently.

Figure 11:
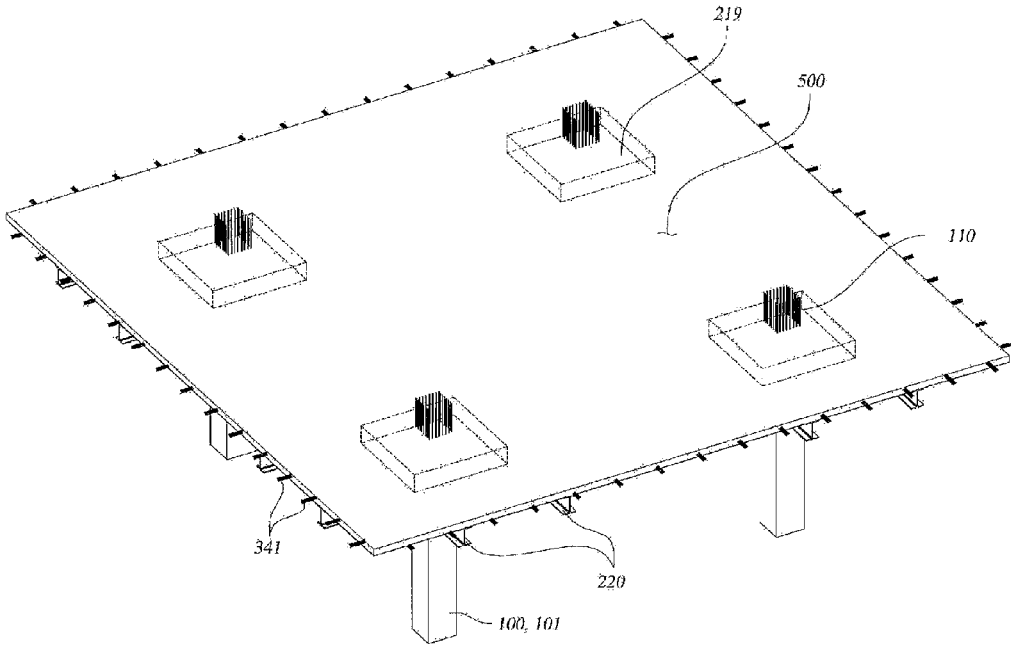
FIG. 11 is a perspective view illustrating the state in which concrete is poured into the construction of FIG. 10.
Figure 12:
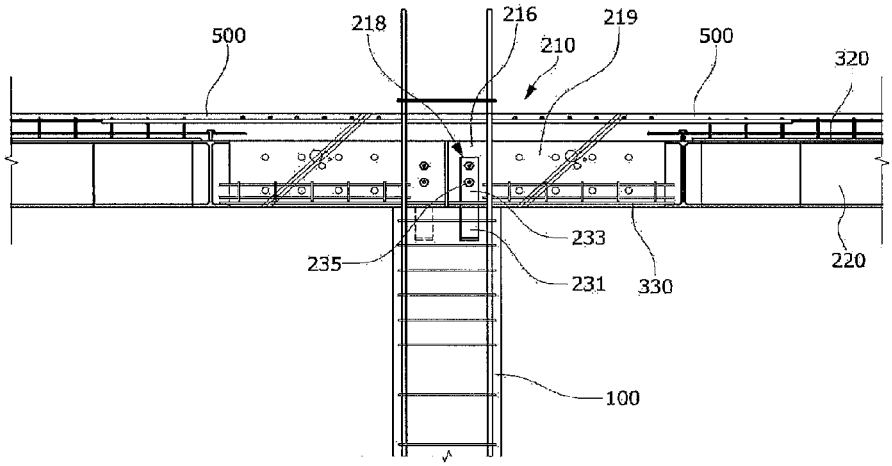
FIG. 12 is a vertical sectional view illustrating the part of the column of FIG. 11.
Figure 12:
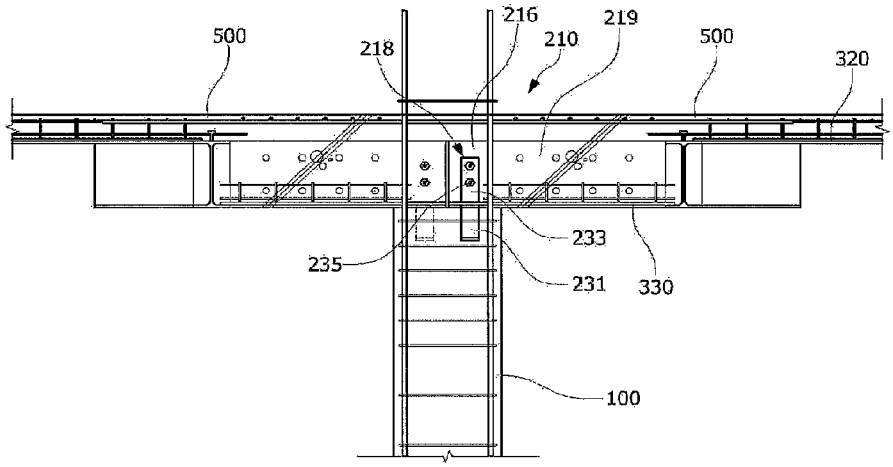

FIG. 11 is a perspective view illustrating the state in which concrete is poured into the construction of FIG. 10, and FIG. 12 is a vertical sectional view illustrating the part of the column of FIG. 11.

In the seventh step S170, concrete is poured into the internal space 214 and onto the upper horizontal mold 320 to form a drop panel 219 and a slab structure 500 as shown in FIGS. 11 and 12.

That is, through the seventh step S170, as shown in FIG. 12, the drop panel 219 is formed in the internal space 214, and the slab structure 500 is provided on the upper horizontal mold 320. FIG. 12(*a*) shows the construction in which the linear member 220 is provided, and FIG. 12(*b*) shows the construction in which the linear member 220 is not provided.

By the seventh step S170, construction on one floor is completed.

Examining the vertical sections of the column 100, the connecting member 210, and the linear member 220 after the construction on one floor is completed via the seventh step S170, as shown in FIGS. 2 and 12, the concrete is poured into the internal space 214 of the connecting member 210, the concrete drop panel 219 has the tensile strength much stronger than that of the linear member 220 or the slab structure 500, which are iron framed.

Thus, sagging is mainly applied to only a portion of the linear member 220 or the slab structure 500 provided between the connecting members 210, the length thereof is reduced by the amount of the connecting member 210 protruding from the circumference of the column 100, so that bending displacement E occurring on a portion of the linear member 220 and the slab structure 500 between the connecting members 210 due to sagging is reduced.

According to the invention, due to the existence of the drop panel 219, the linear member 220, or the slab structure 500, provided between the connecting members 210, is partially reduced in length, having the effect of reducing sagging displacement that occurs on a portion of the linear member 220 or the slab structure 500 due to sagging, while the linear member 220 or the slab structure 500 is of small thickness and size.

Further, the installation of the lower horizontal mold 330 on the lower side of the internal space 214 enables the pouring of the concrete into the internal space 214, the four unit rods 212 advantageously define the internal space 214, and the coupling rod 216 allows the connecting member 210 to be placed on the respective floors of the column 100.

When the connecting member 210 is placed on the upper end of the column 100, the coupling rod 216 is coupled with the column 100 using a coupling section 218, a lower portion 218 of which is embedded into the reinforced concrete column 100 as shown in FIG. 12, in the course of pouring concrete into the vertical mold 102 as shown in FIG. 5.

Further, an upper portion 233 of the coupling section 218, which is not embedded into the reinforced concrete column 100, is fastened to the coupling rod 216 by means of bolt-coupling A second embodiment method of constructing the drop panel structure will now be described.

Figure 13:
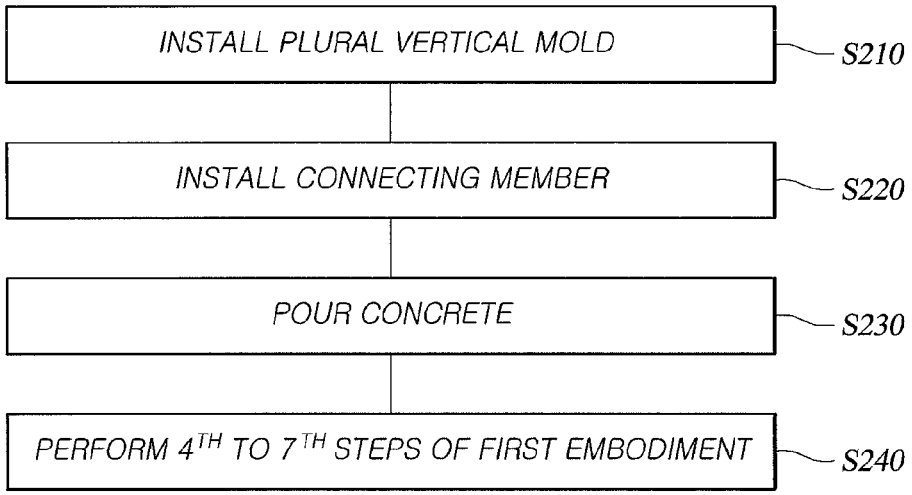
FIG. 13 is a flow chart illustrating a procedure of a second embodiment method of constructing the drop panel structure.
Figure 14:
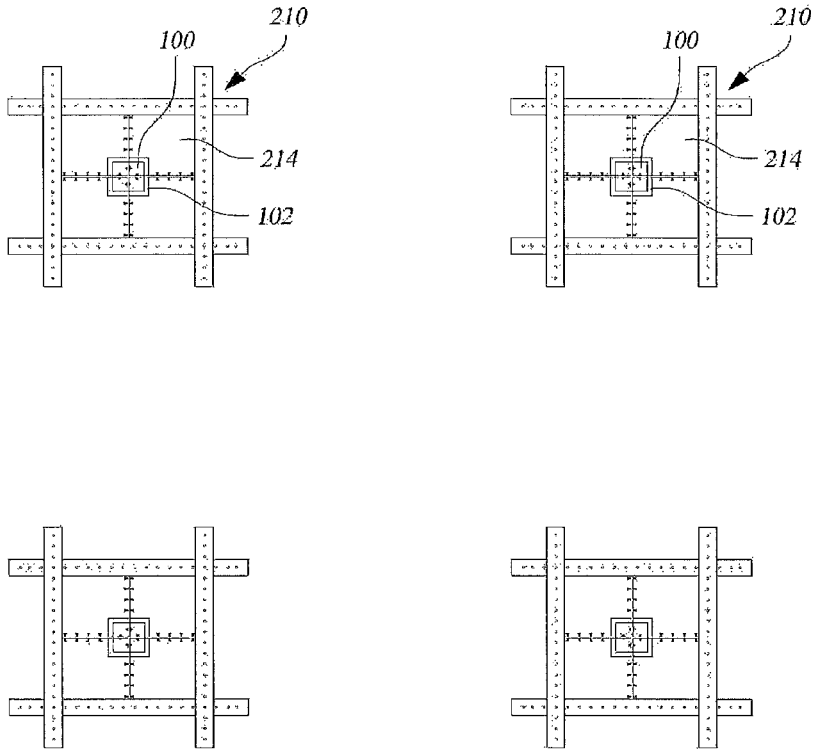
FIG. 14 is a horizontal sectional view illustrating the state in which the connecting members are installed in place on the respective floors of the mold for a column.
Figure 15:
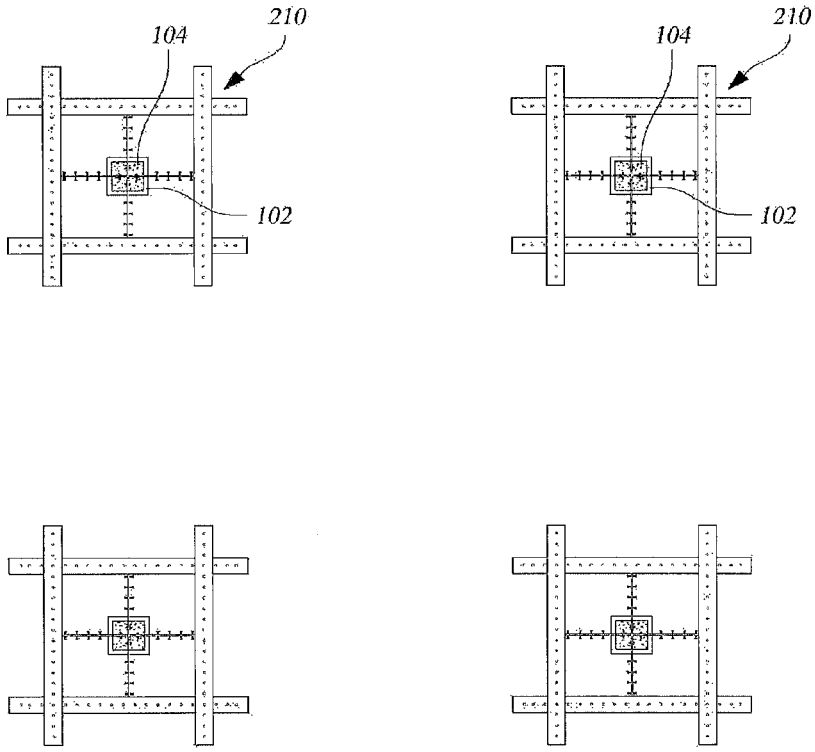
FIG. 15 is a horizontal sectional view illustrating the state in which concrete is poured into the mold for a column of FIG. 14.

FIG. 13 is a flow chart illustrating a procedure of the second embodiment method of constructing the drop panel structure, FIG. 14 is a horizontal sectional view illustrating the state in which the connecting members are installed in places on the respective floors of the mold for a column, and FIG. 15 is a horizontal sectional view illustrating the state in which concrete is poured into the mold for a column of FIG. 14.

In the first step S210, the plurality of vertical molds 102 is installed as shown in FIG. 4, a step which is identical to the first step S110 of the first embodiment.

In the second step S220, the connecting member 210 is installed on the respective floors of the vertical mold 102 as shown in FIG. 14, the connecting member having the internal space 214, the cross-section area of which is larger than that of the column 100. The column 100 may be replaced with a wall body, and in this case, the cross-section area of the column 100 corresponds to that of the wall body.

In the third step S230, concrete 104 is poured into the vertical mold 102 as shown in FIG. 15.

Subsequent steps after the fourth step S240 of the second embodiment are identical to the fourth to seventh steps S140 to S170 of the first embodiment.

Thus, the second embodiment is different from the first embodiment in that after the first step S210, unlike the second step S120 of the first embodiment, the second step S220 is conducted to install the connecting member 210 on the respective floors of the vertical mold 102, without pouring the concrete into the vertical mold 102, and then the third step S230 is conducted to pour the concrete into the vertical mold 102.

A third embodiment method of constructing the drop panel structure will now be described.

Figure 16:
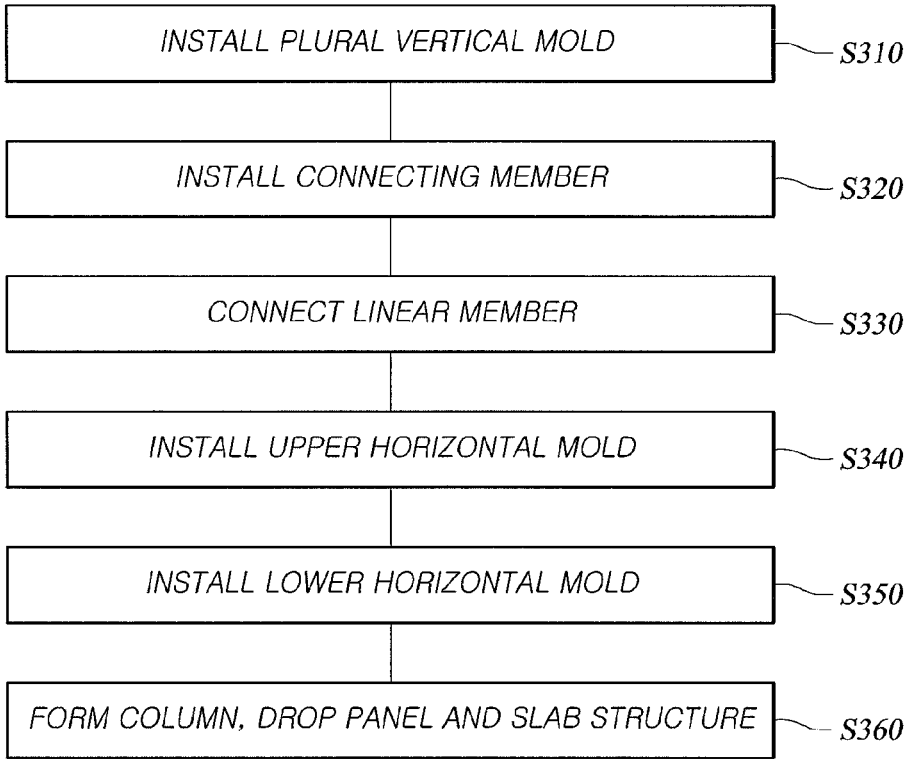
FIG. 16 is a flow chart illustrating a procedure of a third embodiment method of constructing the drop panel structure.
Figure 17:
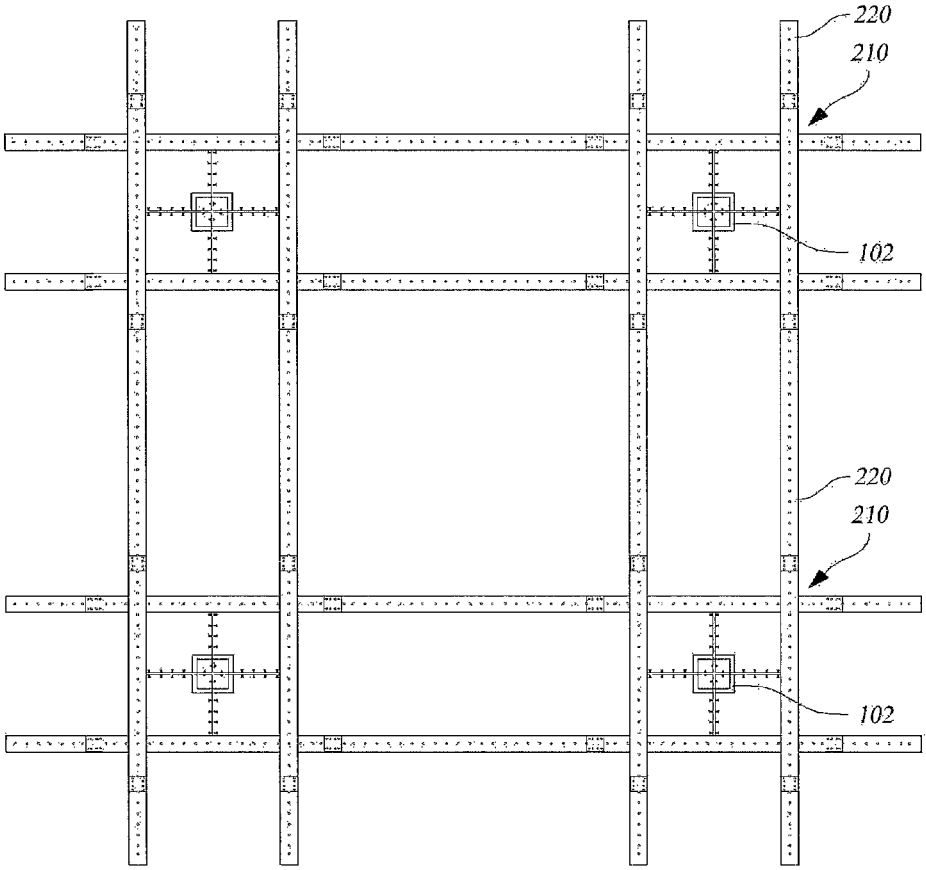
FIG. 17 is a horizontal sectional view illustrating the state in which the connecting members and the linear members are installed in places on the respective floors of the mold for a column.
Figure 18:
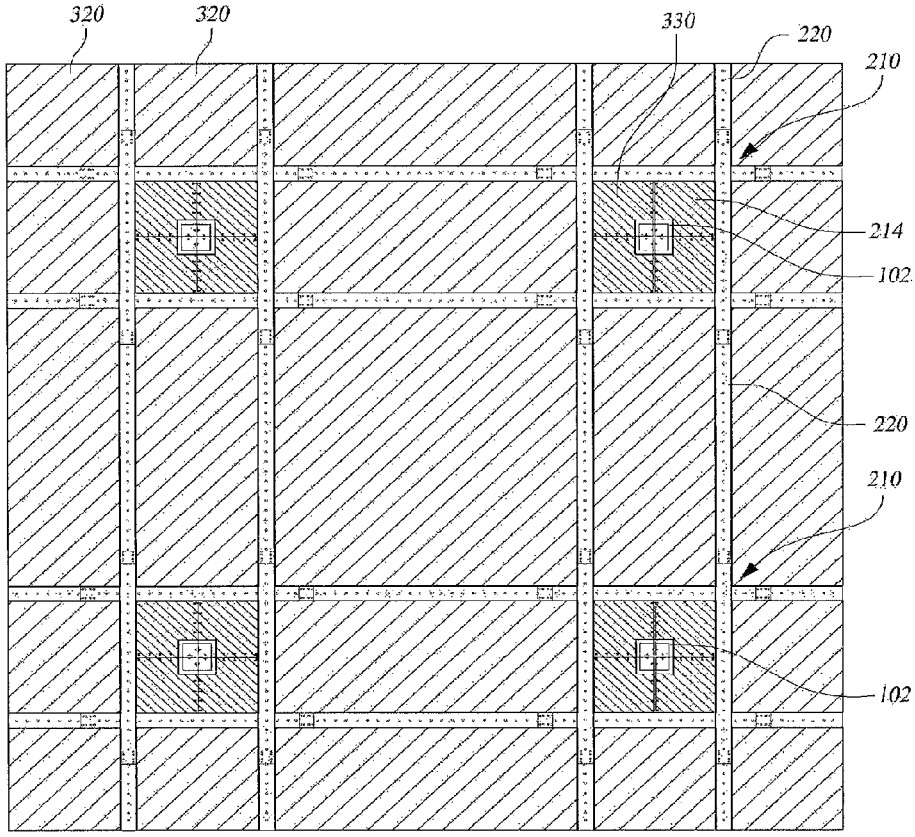
FIG. 18 is a horizontal sectional view illustrating the state in which a horizontal mold is installed in the construction of FIG. 17.

FIG. 16 is a flow chart illustrating a procedure of the third embodiment method of constructing the drop panel structure, FIG. 17 is a horizontal sectional view illustrating the state in which the connecting members and the linear members are installed in places on the respective floors of the mold for a column, and FIG. 18 is a horizontal sectional view illustrating the state in which a horizontal mold is installed in the construction of FIG. 17.

In the first step S310, the plurality of vertical molds 102, shaped like the reinforced concrete column 100 or wall body, is installed as shown in FIG. 4, a step which is identical to the first steps S110 and S210 of the first and second embodiments.

In the second step S320, the connecting member 210 is installed on the respective floors of the vertical mold 102 as shown in FIG. 14, the connecting member having the internal space 214, the cross section of which is larger than that of the column 100 or wall body.

In the third step S330, the linear member 220 is connected to the plurality of connecting members 210 as shown in FIG. 17, a step which is different from the fourth step S140 of the first embodiment in that the concrete is not poured into the vertical mold 102.

If needed, only the upper horizontal mold 320 for forming a slab between the connecting members 210 may be installed as follows.

Meanwhile, the fourth step S340 is conducted to install the upper horizontal mold 320 between the linear members 220 as shown in FIG. 18, a step which is different from the fifth step S150 of the first embodiment in that the concrete is not poured into the vertical mold 102.

In the fifth step S350, the lower horizontal mold 330 is installed on the lower side of the internal space 214, and the reinforcing rods 341 are placed on the upper horizontal mold 320 and the lower horizontal mold 330 as shown in FIG. 18, through which the construction obtained is expressed as shown in FIG. 10, if the column 100 is replaced with the vertical mold 102.

The sixth step S360 is conducted to pour concrete into the vertical mold 102, the internal space 214, and the upper horizontal mold 320 to form the drop panel 219 and the slab structure 500 in connection with the column 100 or the wall body, with the result that the construction will be provided as shown in FIGS. 11 and 12.

The drop panel structure obtained through the process includes the plurality of reinforced concrete columns 100 or walls, the connecting member 210 having the concrete drop panel 219 placed on the respective floors of the column 100 or wall and having the cross-section area larger than that of the column 100 or wall, and a portion of the linear member 220 connected to the plurality of connecting members 210 or the slab structure 500 between the connecting members 210.

Since the connecting member 210 includes the concrete drop panel 219, the amount of sagging of the connecting member 210 becomes smaller than that of a portion of the linear member 220 or the slab structure 500 between the connecting members 210.

Figure 19:
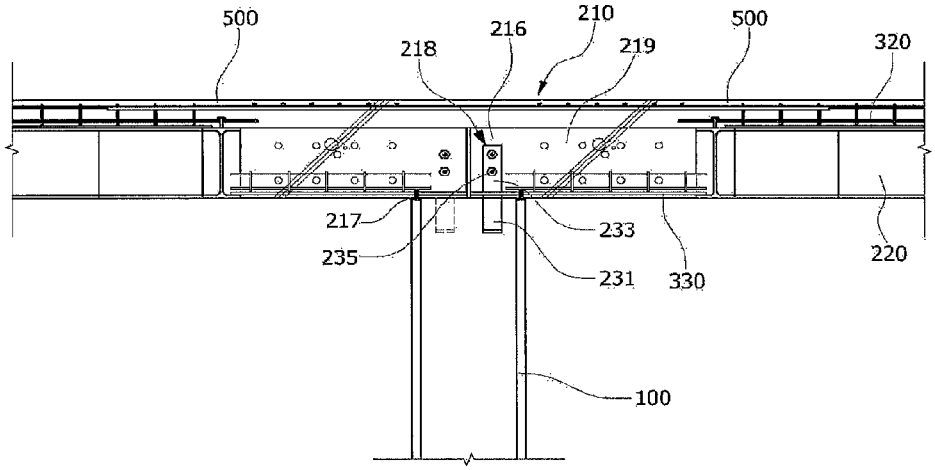
FIG. 19 is a vertical sectional view illustrating the state in which the connecting member is installed to the mold.
Figure 19:
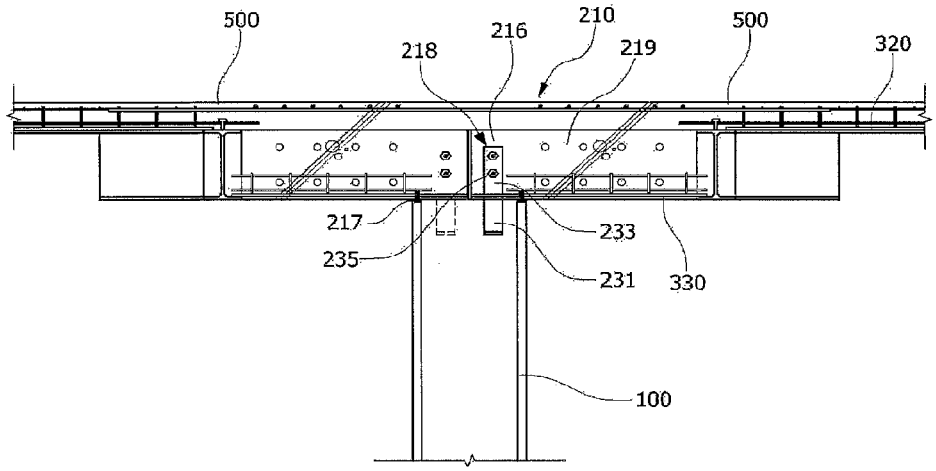

Further, in the first to third embodiments, as shown in FIG. 19, the vertical mold 102 is fastened to the connecting member 210 by means of a bolt 217, and, since bolt coupling is a conventional coupling manner, the detailed description thereof will be omitted.

A fourth embodiment method of constructing the drop panel structure will now be described.

Figure 20:
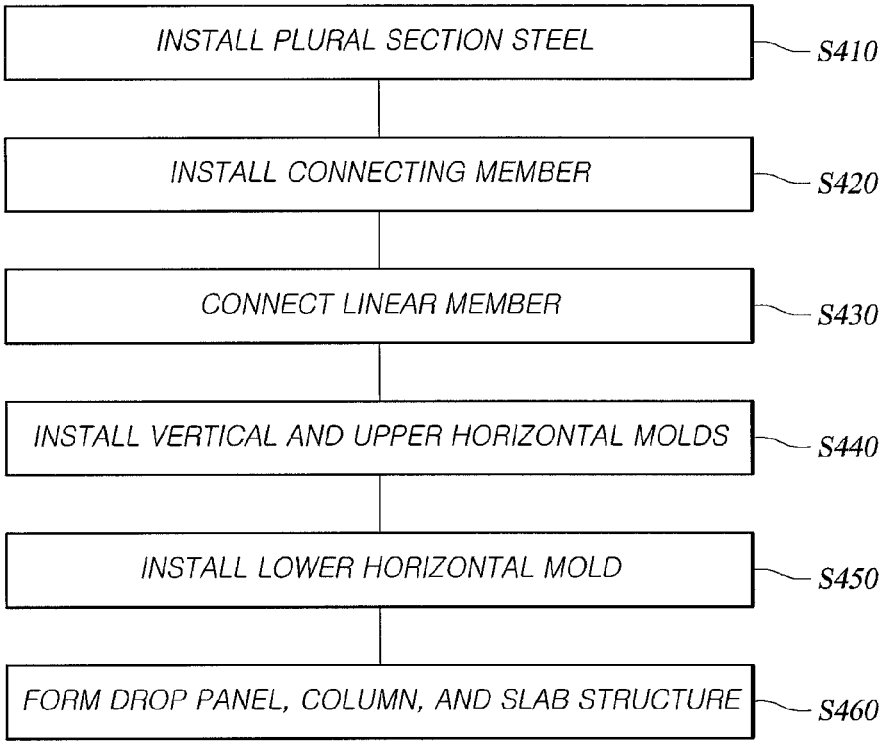
FIG. 20 is a flow chart illustrating a procedure of a fourth embodiment method of constructing the drop panel structure.
Figure 21:
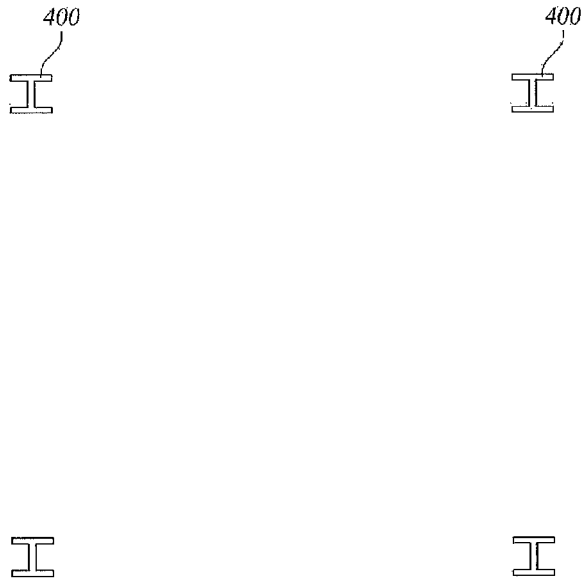
FIG. 21 is a horizontal sectional view illustrating the state in which section steel is vertically installed in the construction of the invention.
Figure 22:
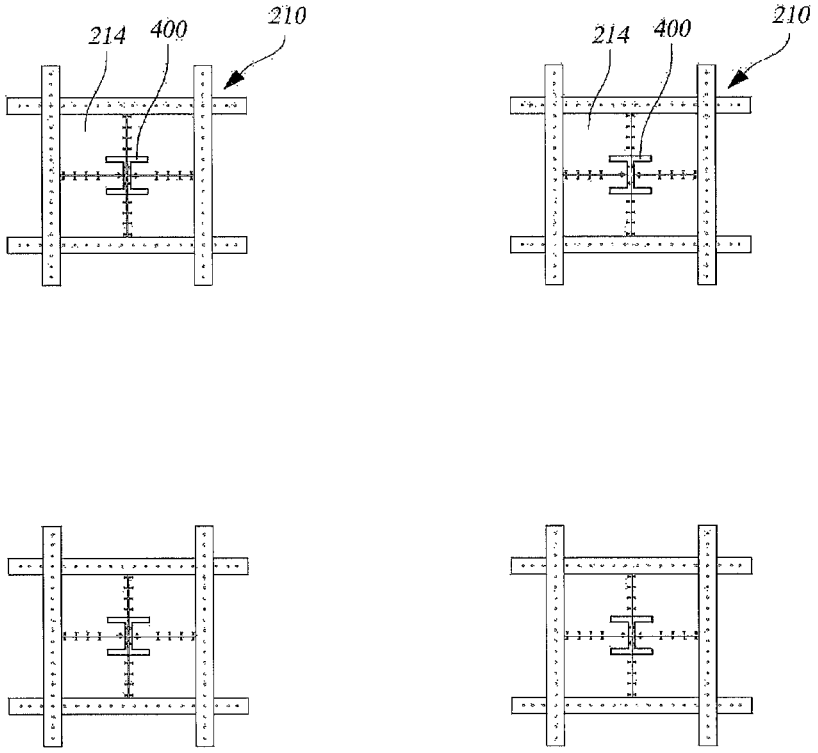
FIG. 22 is a horizontal sectional view illustrating the state in which the connecting members are installed in places on the respective floors of the section steel of FIG. 21.
Figure 23:
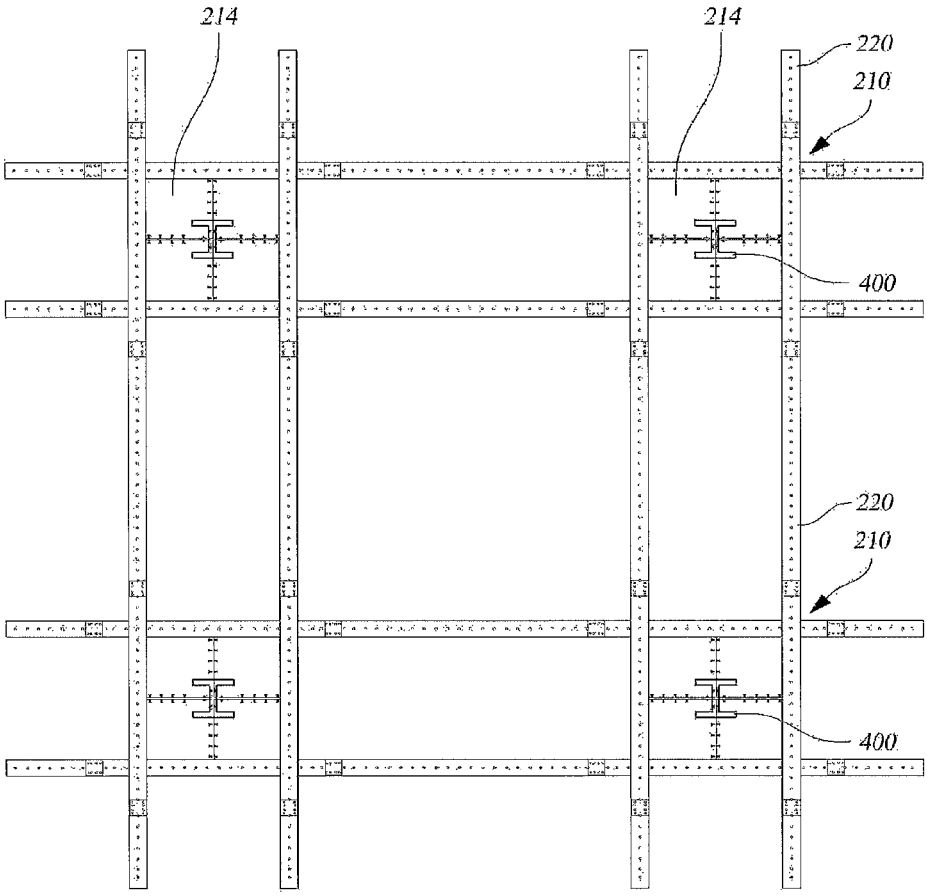
FIG. 23 is a horizontal view illustrating the state in which the linear members are connected to the connecting members of FIG. 22.
Figure 24:
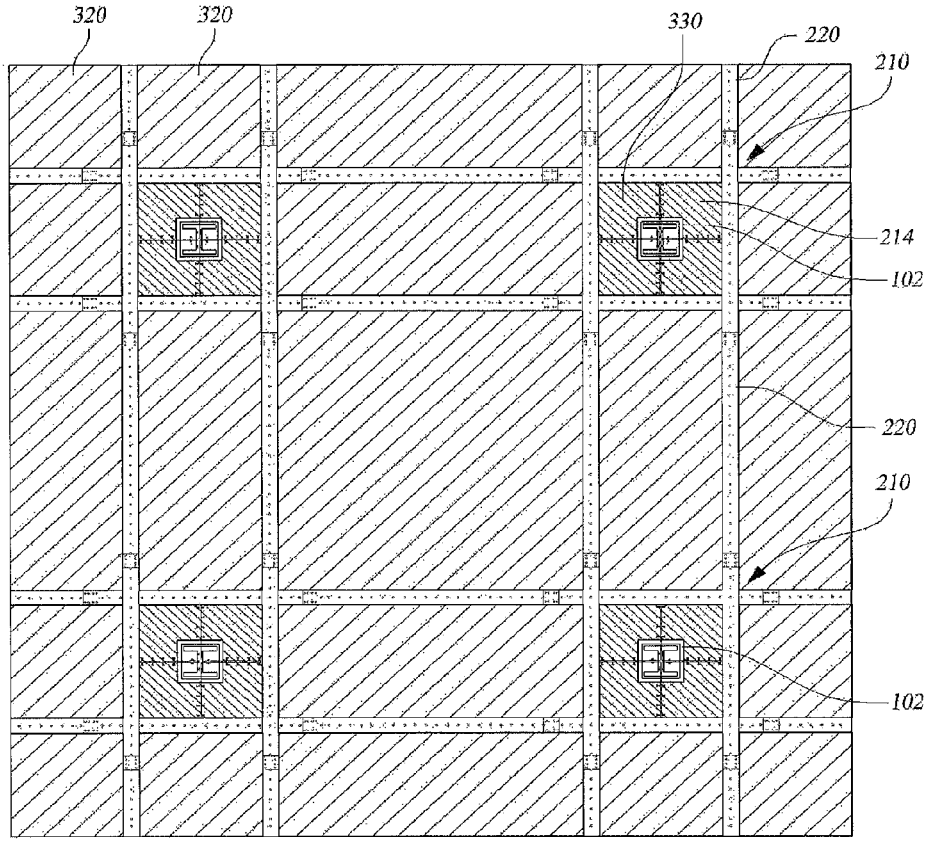
FIG. 24 is a horizontal sectional view illustrating the state in which vertical and horizontal molds are installed in the construction of FIG. 23.

FIG. 20 is a flow chart illustrating a procedure of the fourth embodiment method of constructing the drop panel structure, FIG. 21 is a horizontal sectional view illustrating the state in which section steel is vertically installed in the construction of the invention, FIG. 22 is a horizontal sectional view illustrating the state in which the connecting members are installed in places on the respective floors of the section steel of FIG. 21, FIG. 23 is a horizontal view illustrating the state in which the linear members are connected to the connecting members of FIG. 22, and FIG. 24 is a horizontal sectional view illustrating the state in which vertical and horizontal molds are installed in the construction of FIG. 23.

In the first step S410, a plurality of section steels 400, used in the steel-framed reinforced concrete column 101 as shown in FIG. 11, is installed vertically as shown in FIG. 21.

In the second step S420, the connecting member 210 is installed on the respective floors of the section steel 400 as shown in FIG. 22, the connecting member 210 having the internal space 214, the cross section of which is larger than that of the column 101.

In the third step S430, the linear member 220 is connected to the plurality of connecting members 210 as shown in FIG. 23.

If needed, only the upper horizontal mold 320 may be installed between the connecting members 210 without providing the linear member 220.

In the fourth step S440, the vertical mold 102, shaped like a column, and the upper horizontal mold 320 are installed around the column and between the linear members 220.

In the fifth step S450, the lower horizontal mold 330 is installed on the lower side of the internal space 214, and reinforcing rods 341 are placed on the upper horizontal mold 320 and the lower horizontal mold 330, through which step the construction obtained is provided as shown in FIG. 10, if the column 100 is replaced with the vertical mold 102 in which the section steel 400 is provided.

In the sixth step S460, concrete is poured into the internal space 214, the vertical mold 102, and the upper horizontal mold 320 to form the drop panel 219, the column 101, and the slab structure 500 as shown in FIG. 11.

The drop panel structure obtained through the process includes the plurality of steel-framed reinforced concrete columns 101, the connecting member 210 having the concrete drop panel 219 placed on the respective floors of the column 101 and having the cross-section area larger than that of the column 101, and a portion of the linear member 220 connected to the plurality of connecting members 210 or the slab structure 500 between the connecting members 210.

Since the connecting member 210 includes the concrete drop panel 219, the amount of sagging of the connecting member 210 becomes smaller than that of a portion of the linear member 220 or the slab structure 500 between the connecting members 210 owing to the existence of the drop panel 219.

Figure 25:
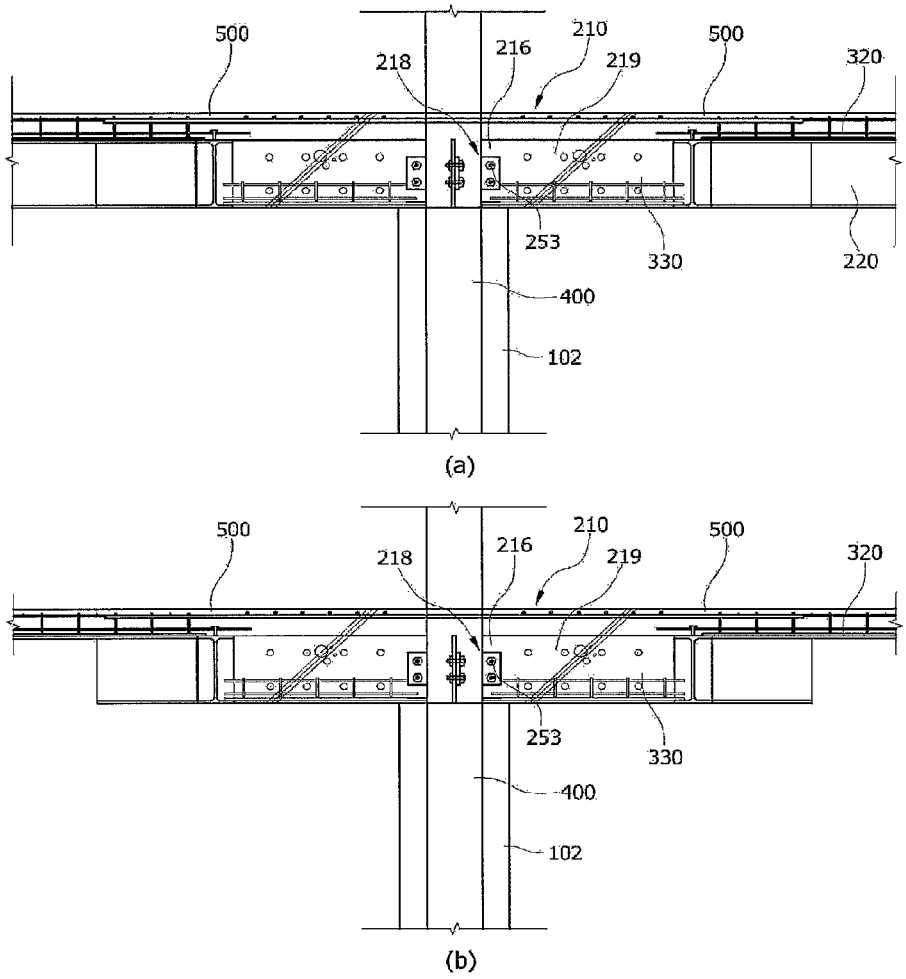
FIG. 25 is a vertical sectional view illustrating the state in which the connecting members are connected to the section steel.

FIG. 25 is a vertical sectional view illustrating the state in which the connecting members are connected to the section steel.

In the second step S420 of the fourth embodiment, the connecting member 210 is connected to the section steel 400 by means of the coupling section 218 and the bolt 253.

As the bolt coupling is a conventional coupling method, the detailed description thereof will be omitted.

Figure 26:
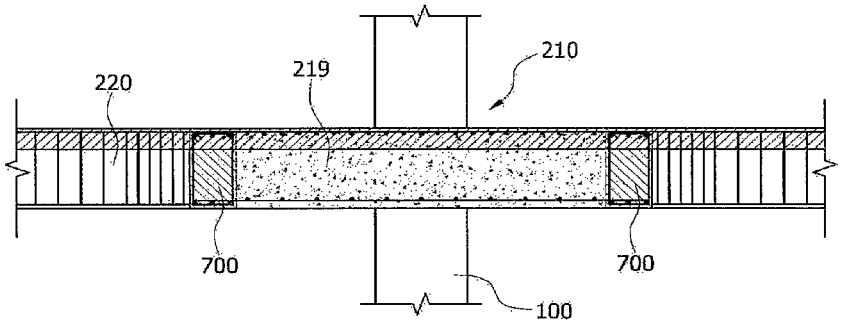
FIG. 26 is a vertical sectional view illustrating the state in which the connecting members are connected to the reinforced concrete beam of the invention.
Figure 26:
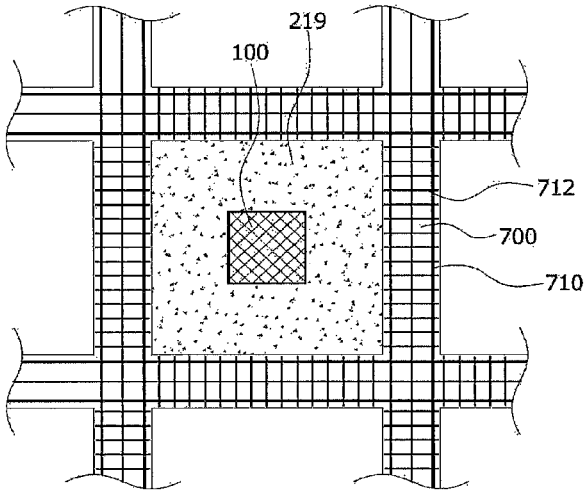
Figure 27:
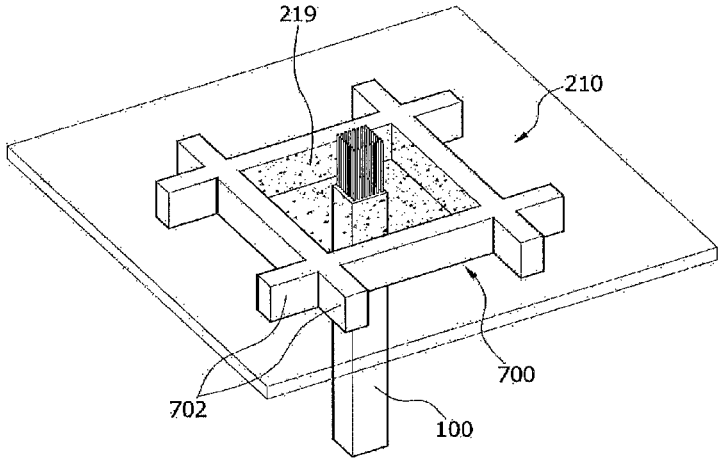
FIGS. 27 and 28 are perspective views illustrating the column and the connecting member of the invention.
Figure 28:
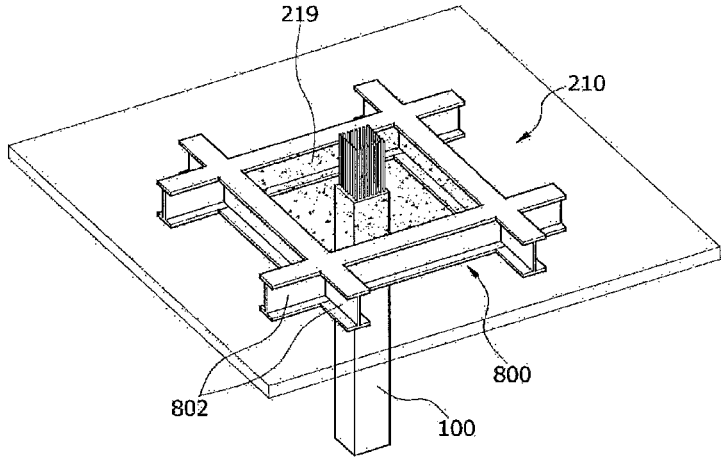

FIG. 26 is a vertical sectional view illustrating the state in which the connecting members are connected to the reinforced concrete beam of the invention, and FIGS. 27 and 28 are perspective views illustrating the column and the connecting member of the invention.

The portion of the connecting member 210 of the drop panel structure, which is formed into a latticing form, will be hereinafter referred to as a "structural member" 700 or 800.

The structural members 700 or 800 intersect each other at the same level in a manner as to be parallel with the respective surfaces of the column 100, outside the drop panel 219, to form a latticing form.

The structural member 700 or 800 is formed with a reinforced concrete beam 700, in which main reinforcement steels 710 are coiled with the stirrup 712, or a steel-framed beam 800.

A connecting end 702 provided in the reinforced concrete beam 700 as shown in FIG. 27 facilitates the connection between the connecting member 210 and the reinforced concrete structure to be connected thereto, and reinforcing the connecting strength as well.

Further, a connecting end 802 provided in the steel-framed beam 800 as shown in FIG. 28 facilitates the connection between the connecting member 210 and the steel-framed structure to be connected thereto, and reinforcing the connecting strength as well.

The connecting member 210 having the connecting end 702 or 802 will now be described in more detail.

First, if the connecting member 210 is connected to the linear member or the slab via the connecting end 702 or 802, the connection becomes easy and the connecting strength becomes improved owing to the shape of the connecting end 702 or 802.

Second, if the slab is formed on the connecting member 210 without the connecting member 210 being connected to other member via the connecting end 702 or 802, the connecting member 210 serves to reduce the sagging of the slab.

Here, in the case that the connecting member 210 is formed into a rectangular shape, which simply surrounds the drop panel 219, the connecting member only reduces the sagging of the slab by the size of the rectangular area. Thus, in order to improve the effect, the drop panel, and therefore the connecting member surrounding the drop panel, have to be made larger, so that the cost of manufacturing the drop panel 219 and the rectangular connecting member increases.

However, since the connecting member 210 of the invention is formed into a latticing form so that the connecting end 702 or 802 is provided in addition to the drop panel 219 and the member surrounding the drop panel, the sagging of the slab is furthermore reduced by the existence of the connecting end 702 or 802.

Thus, even though the drop panel 219 is not made larger, the sagging of the slab can advantageously be maximally restricted by the portion of the connecting end 702 or 802.

Accordingly, the invention provides effects of utilizing technical benefits to the maximum in that even though the drop panel 219 is not made larger, the sagging of the slab can be greatly reduced while the constructing cost is saved.

Figure 29:
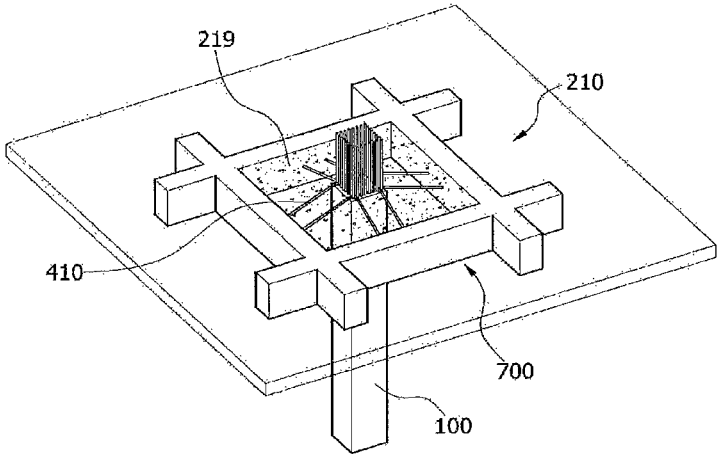
FIGS. 29 and 30 are perspective views illustrating the state in which a slant tension member is installed to the connecting member.
Figure 30:
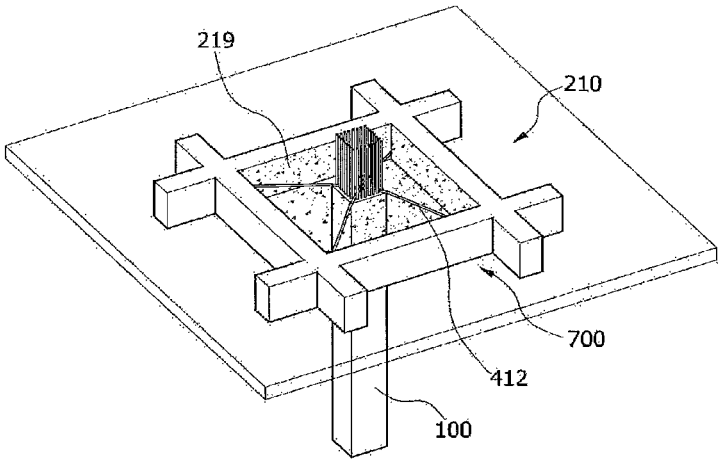

FIGS. 29 and 30 are perspective views illustrating the state in which a slant tension member is installed to the connecting member. In FIG. 29, the slant tension member 410 is installed parallel with or perpendicular to the respective surfaces of the neighboring column 100 as seen in a plan view so as to connect the column 100 and the reinforced concrete beam 700 to each other in an inclined state in the connecting member 210. In FIG. 30, the slant tension member 412 is installed at an angle of 45° to the respective surface of the neighboring column 100 as seen in a plan view so as to connect the column 100 and the reinforced concrete beam 700 to each other in an inclined state in the connecting member 210.

The slant tension member 410 or 412 serves to prevent the latticed connecting member 210 from sagging outwards. The slant tension member 410 of FIG. 29 has a benefit in installation, and the slant tension member 412 of FIG. 30 has a benefit in effective sag prevention.

Figure 31:
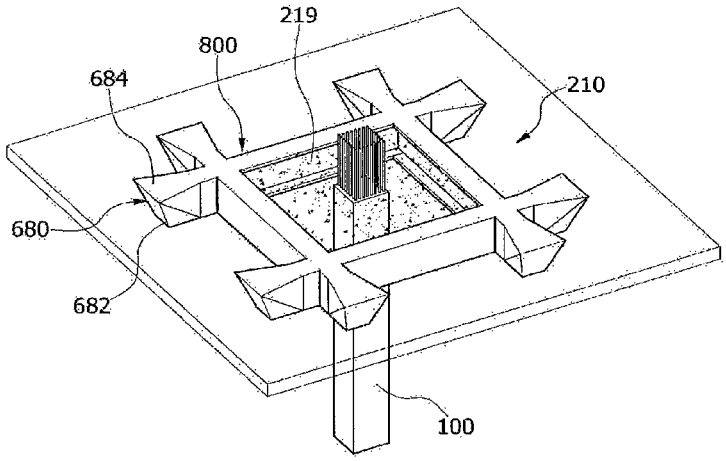
FIGS. 31 and 32 are perspective view illustrating the connecting member whose sectional area is enlarged.
Figure 32:
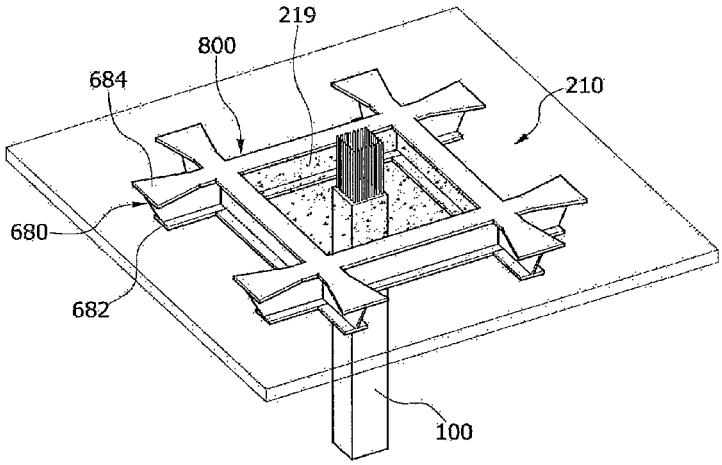

FIGS. 31 and 32 are perspective views illustrating the connecting member whose sectional area is enlarged.

In FIG. 31, a connecting end 600 of the reinforced concrete beam 700 is configured such that a cross-section area of the upper portion 614 is larger than that of the lower portion 612, so that deformation due to load applied to the connecting member 210 is reduced more effectively.

Further, in FIG. 32, a connecting end 680 of the steel-framed beam 800 is configured such that a cross-section area of the upper portion 684 is larger than that of the lower portion 682, so that deformation due to load applied to the connecting member 210 is reduced more effectively.

Although preferred embodiments of the present invention have been described for illustrative purposes, those skilled in the art will appreciate that the present invention is not limited thereto, but various modifications, additions and substitutions are possible without departing from the scope and spirit of the invention as disclosed in the accompanying claims.

The invention claimed is:

1. A latticing drop panel structure comprising: a plurality of columns or walls; and a connecting member associated with each of said plurality of columns and including a concrete drop panel having a cross-section area larger a column, wherein the connecting member comprises four unit rods, surrounded around the drop panel in a latticing form wherein a first unit rod is provided parallel and spaced apart from a second unit rod and said first unit rod is further provided perpendicular to a third and a fourth unit rod, each of said four unit rods having a first end and a second end, wherein said first end and said second end of each of said unit rods extend beyond a perimeter of the drop panel, said first end of said first unit rod extending beyond a said third unit rod and said second end extending beyond said fourth unit rod; and wherein the unit rods are parallel with respective sides of the plurality of columns and an upper surface of each of the four unit rods are provided in the same horizontal plane.

2. The latticing drop panel structure according to claim 1, wherein the column includes reinforced concrete or steel-framed reinforced concrete.

3. The latticing drop panel structure according to claim 2, wherein the connecting member is composed of H-section steel.

4. The latticing drop panel structure according to claim 1, wherein the unit rod has a connecting end a cross-section area of which is larger at an upper side than at a lower side.

5. The latticing drop panel structure according to claim 1, wherein a slant tension member is coupled to the connecting member in the same or slant direction as or from the connecting member.

6. The latticing drop panel structure according to claim 1, wherein the unit rod is a reinforced concrete beam in which a plurality of main reinforcement steel is coiled with stirrups.

7. The latticing drop panel structure according to claim 1, wherein the unit rod is a steel beam.

8. A method of constructing a latticing drop panel structure, the method comprising the steps of:

installing a connecting member in at least one of a plurality of floors associated with a plurality of reinforced concrete columns or walls, the connecting member having an internal space, the cross-section area of which is larger than that of the column or wall, the connecting member comprising four unit rods, a first unit rod is provided parallel and spaced apart from a second unit rod and said first unit rod is further provided perpendicular to a third and fourth unit rod, each of said four unit rods having a first end and a second end, wherein said first end and said second end of each of said unit rods extend beyond the internal space, said first end of each of said first unit rod extending beyond a said third unit rod and said second end extending beyond a said fourth unit rod, and wherein the unit rods are parallel with respective sides of the plurality of columns and an upper surface of each of the four unit rods are provided in the same horizontal plane; and connecting a linear member to each of the plurality of connecting members;

installing an upper horizontal mold between the linear members; and pouring concrete into the internal space and onto the upper horizontal mold to form a drop panel and a slab structure.

9. A method of constructing a latticing drop panel structure, the method comprising the steps of:

installing a plurality of vertical molds shaped like a reinforced concrete column or wall;

installing a connecting member in at least one of a plurality of floors associated with the vertical molds, the connecting member having an internal space, the cross-section area of which is larger than that of the column or wall, the connecting member comprising four unit rods, a first unit rod is provided parallel and spaced apart from a second unit rod and said first unit rod is further provided perpendicular to a third and fourth unit rod, each of said four unit rods having a first end and a second end, wherein said first end and said second end of each of said unit rods extend beyond the vertical mold, said first end of each of said first unit rod extending beyond a said third unit rod and said second end extending beyond a said fourth unit rod, wherein the unit rods are parallel with respective sides of the plurality of columns and an upper surface of each of the four unit rods are provided in the same horizontal plane;

pouring concrete into the vertical mold; connecting a linear member to the plurality of connecting members; installing an upper horizontal mold between the linear members; and pouring concrete into the internal space and onto the upper horizontal mold to form a drop panel and a slab structure.

10. A method of constructing a latticing drop panel structure, the method comprising the steps of:

installing a plurality of vertical molds, shaped like a reinforced concrete column or wall;

installing a connecting member in a plurality of floors associated with the vertical molds, the connecting members having an internal space, the cross-section area of which is larger than that of the column or wall, and the connecting members comprising four unit rods, a first unit rod is provided parallel and spaced apart from a second unit rod and said first unit rod is further provided perpendicular to a third and fourth unit rod, each of said four unit rods having a first end and a second end, wherein said first end and said second end of each of said unit rods extend beyond the vertical mold, said first end of each of said first unit rod extending beyond a said third unit rod and said second end extending beyond a said fourth unit rod, wherein the unit rods are parallel with respective sides of the plurality of columns and an upper surface of each of the four unit rods are provided in the same horizontal plane;

connecting a linear member to each of the plurality of connecting members;

installing an upper horizontal mold between the linear members; and pouring concrete into the internal space and onto the upper horizontal mold to form a drop panel and a slab structure in connection with the column or wall.

11. A method of constructing a latticing drop panel structure, the method comprising the steps of:

installing a plurality of section steel, used in a steel-framed reinforced concrete column, in a vertical manner;

installing a connecting member in at least one of a plurality of floors associated with the plurality of section steel, the connecting member having an internal space, the cross-section area of which is larger than that of the column, and the connecting member comprising four unit rods, a first unit rod is provided parallel and spaced apart from a second unit rod and said first unit rod is further provided perpendicular to a third and fourth unit rod, each of said four unit rods having a first end and a second end, wherein said first end and said second end of each of said unit rods extend beyond the section steel, said first end of each of said first unit rod extending beyond a said third unit rod and said second end extending beyond a said fourth unit rod, wherein the unit rods are parallel with respective sides of the plurality of columns and an upper surface of each of the four unit rods are provided in the same horizontal plane;

connecting a linear member to the plurality of connecting members; installing a vertical mold shaped like the column; installing an upper horizontal mold between the linear members;

pouring concrete into the vertical mold to form the column; and pouring concrete into the internal space and onto the upper horizontal mold to form a drop panel and a slab structure.

12. The method according to claim 8, wherein a coupling section is embedded in the reinforced concrete column to connect the connecting member and the column to each other.

13. The method according to claim 8, wherein the connecting member is composed of four unit rods crossed into a latticing form with the internal space formed at the center of the latticing form.

14. The method according to claim 8, wherein the method comprises the step of installing a lower horizontal mold on a lower side of the internal space.

15. The method according to claim 9, wherein the connecting member and the vertical mold are fastened to each other by a bolt.

* * * * *